United States Patent [19]

Van Meurs et al.

[11] Patent Number: 4,570,715

[45] Date of Patent: Feb. 18, 1986

[54] FORMATION-TAILORED METHOD AND APPARATUS FOR UNIFORMLY HEATING LONG SUBTERRANEAN INTERVALS AT HIGH TEMPERATURE

[75] Inventors: Peter Van Meurs; Cor F. Van Egmond, both of Houston, Tex.

[73] Assignee: Shell Oil Company, Houston, Tex.

[21] Appl. No.: 597,764

[22] Filed: Apr. 6, 1984

[51] Int. Cl.[4] ..... E21B 23/00; E21B 36/04

[52] U.S. Cl. ..... 166/302; 166/60; 166/72; 166/385; 166/65.1; 219/415

[58] Field of Search ..... 166/60, 302, 385, 65 R, 166/72; 219/415, 417

[56] References Cited

U.S. PATENT DOCUMENTS

| | | | |
|---|---|---|---|
| 2,500,513 | 3/1950 | Bowman | 166/60 X |
| 2,732,195 | 1/1956 | Ljungström | 166/302 |
| 2,781,851 | 2/1957 | Smith | 166/60 |
| 2,893,490 | 7/1959 | Wiliams et al. | 166/60 |
| 3,114,417 | 12/1963 | McCarthy | 166/60 |
| 3,131,763 | 5/1964 | Kunetka et al. | 166/60 |
| 3,207,220 | 9/1965 | Williams | 166/60 |
| 3,522,847 | 8/1970 | New | 166/60 |
| 4,440,219 | 4/1984 | Engelder | 166/302 X |

*Primary Examiner*—Stephen J. Novosad

[57] ABSTRACT

Long intervals of subterranean earth formations are heated at high temperatures for long times with an electrical heater containing spoolable, steel sheathed, mineral insulated cables which have high electrical conductivities, enabling them to heat the earth formations at a substantially uniform rate of more than about 100 watts per foot at temperatures between about 600° and 1000° C., with a pattern of localized electrical resistances which are correlated with the heat conductivities of the earth formations and the heat stabilities of materials providing power and support for the heater.

30 Claims, 8 Drawing Figures

FIG. 6
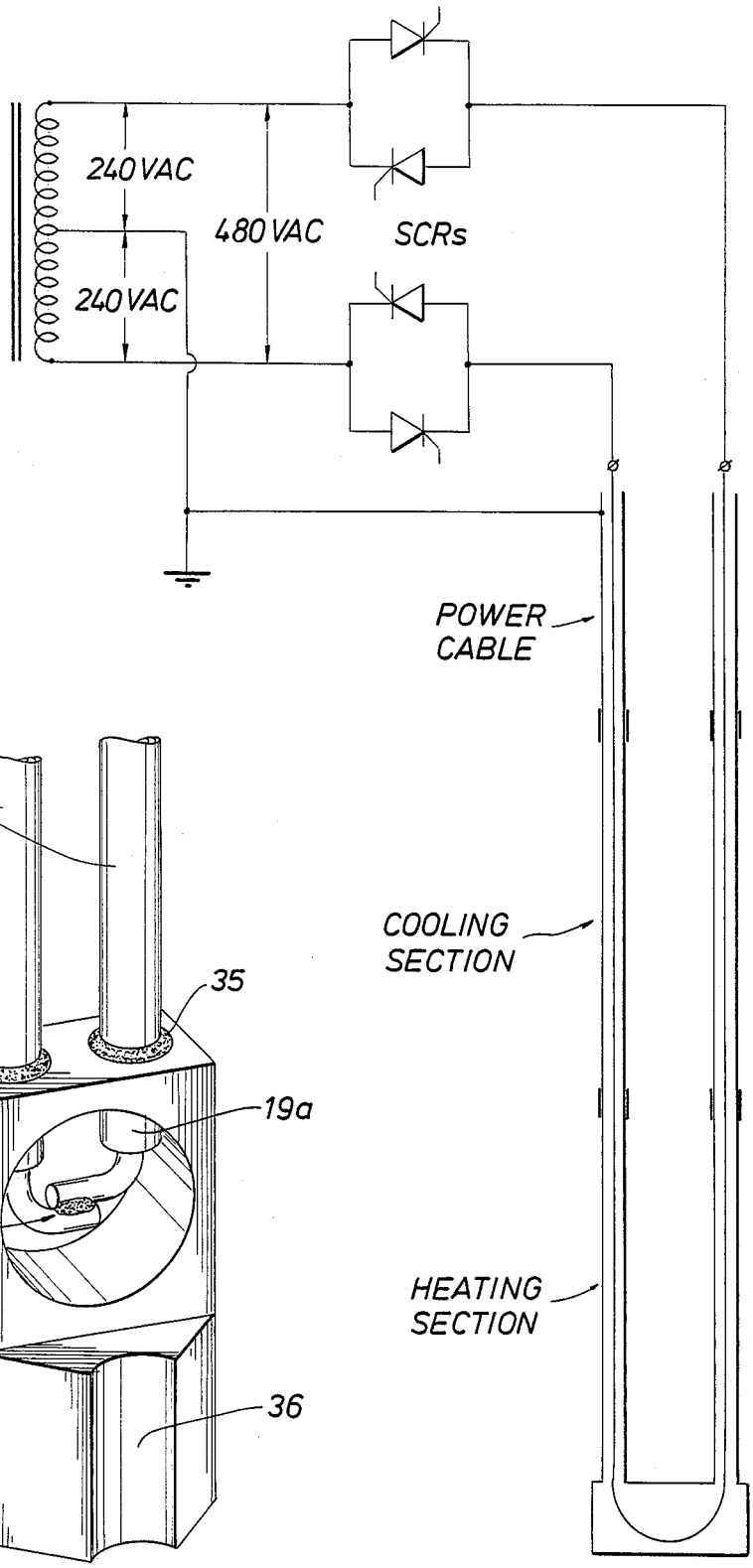
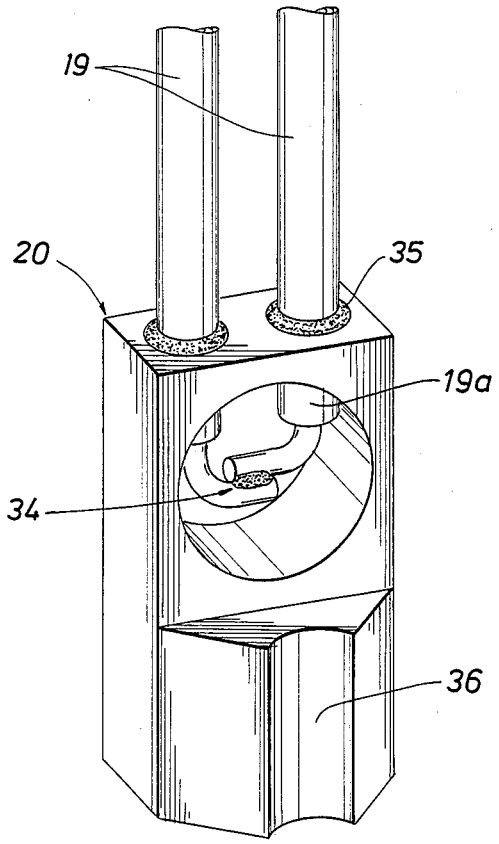
FIG. 5

STATIONARY DRUM
POWER SUPPLY CABLES
ROTATING CABLE GUIDE WITH BRAKE
HEATER CABLES
WAVE LENGTH
AIR MOTOR DRIVEN GUIDE COLUMN SPOOL
HEATER END PIECE SPLICE
GUIDE COLUMN
AIR MOTOR DRIVEN CABLE SPOOL
SINKER BAR
CASINGS

FORMATION-TAILORED METHOD AND APPARATUS FOR UNIFORMLY HEATING LONG SUBTERRANEAN INTERVALS AT HIGH TEMPERATURE

BACKGROUND OF THE INVENTION

This invention relates to heating relatively long intervals of subterranean earth formations at relatively high temperatures for relatively long times. More particularly, it relates to an electrical resistance process of heating which is capable of subjecting an interval of more than several hundred feet of subterranean earth formation to a selected temperature of from about 600° to 1000° C. for a time of more than several years while injecting heat at a rate of more than about 100 watts/-foot.

It is known to be beneficial to heat intervals of subterranean earth formations at relatively high temperatures for relatively long times. The benefits obtained may include the pyrolyzing of oil shale formations, the consolidating of unconsolidated reservoir formations, the formation of large electrically conductive carbonized zones capable of operating as electrodes within reservoir formations, the thermal displacement of hydrocarbons derived from oils or tars into production locations, etc. Prior processes for accomplishing such results are contained in patents such as the following, all of which are U.S. patents. U.S. Pat. No. 2,732,195 describes heating intervals of 20 to 30 meters within subterranean oil shales to temperatures of 500° to 1000° C. with electrical heaters having iron or chromium alloy resistors. U.S. Pat. No. 2,781,851 by G. A. Smith describes using a mineral-insulated and copper-sheathed low resistance heater cable containing three copper conductors at temperatures up to 250° C. for preventing hydrate formation, during gas production, with the heater being mechanically supported by steel bands and surrounded by an oil bath for preventing corrosion. U.S. Pat. No. 3,104,705 describes consolidating reservoir sands by heating residual hydrocarbons within them until the hydrocarbons solidify, with "any heater capable of generating sufficient heat" and indicates that an unspecified type of an electrical heater was operated for 25 hours at 1570° F. U.S. Pat. No. 3,131,763 describes an electrical heater for initiating an underground combustion reaction within a reservoir and describes a heater with resistance wire helixes threaded through insulators and arranged for heating fluids, such as air, being injected into a reservoir. U.S. Pat. No. 4,415,034 describes a process for forming a coked-zone electrode in an oil-containing reservoir formation by heating fluids in an uncased borehole at a temperature of up to 1500° F. for as long as 12 months.

In general, as far as the applicants have been able to ascertain, it appears that prior disclosures of methods or devices for heating underground formations at temperatures as high as 600 to 1000° C. for times as long as even one year, have been limited to heating intervals of only a few hundred feet or less and have usually been operated in contact with, and thus cooled by, fluid flowing into or out of reservoir formations. In various situations it can be advantageous to maintain a temperature of about 600° to 1000° C. along an earth formation interval of more than several hundred feet into which heat is injected at a rate of more than about 100 watts/foot for a time longer than several years. However, in the latter type of operation most insulating materials soon become ineffective, most metals used for electrical resistances would require cross-sectional areas which are unfeasibly large or costly, and/or voltages which are unfeasibly high and dangerous. In addition, at those temperatures, metals commonly used for electrical conductors, power supplies, splicing materials or cable sheaths soften and begin to creep or melt.

SUMMARY OF THE INVENTION

The present invention relates to heating a long interval of subterranean earth formation at a high temperature which can be sustained for a long time. An electrical heater is arranged to have at least one heating element within the interval to be heated. Said heating element or elements consist essentially of (a) an electrically conductive core or conductor which has a relatively low resistance at a high temperature, (b) a core-surrounding insulating material having properties of electrical resistance, compressive strength and heat conductivity which are relatively high at a high temperature and (c) a core and insulation-surrounding metal sheath having properties of tensile strength, creep resistance and softening resistance which are relatively high at a high temperature. Said electrical heater is also arranged so that, along the interval to be heated, the heater has a pattern of electrical resistance with distance, (for example, due to combinations of core cross sectional area and resistance per unit length) which is correlated with the pattern of heat conductivity with distance along the interval of earth formation to be heated. The patterns are correlated so that the temperature of the heater becomes relatively high at locations along said interval at which the heat conductivity within the adjacent earth formations is relatively low. This causes the rate at which heat is generated by the heater and transmitted into the earth formations to be substantially constant all along the interval being heated.

In preferred embodiments, the combinations of resistances and cross sectional areas of heating element cores are arranged to have resistances of about 7 to 12 ohms per 1000 feet, a capability of generating at least about 100 watts per foot of heat and a capability of attaining a selected temperature between about 600° to 1000° C. in response to a selected total electromotive force of less than about 1200 volts between the cores and sheaths of the heating elements.

The heating element cores are preferably insulated by compacted masses of inorganic, nonconductive solid particles. In a particularly preferred embodiment those insulations have properties of electrical resistance, compressive strength and heat conductivity at least substantially equalling those of compacted masses of substantially pure powdered magnesium oxide.

In each of said heating elements, the metal sheaths surrounding the insulated current carrying cores are preferably steel sheaths having diameters and wall thicknesses capable of providing a spoolable heating element cable with properties of tensile strength, creep resistance and softening temperature at least substantially equalling those of a similar heating element cable having a sheath of 316 stainless steel with a diameter of about 1 cm and a wall thickness of about 1 mm.

The metal sheathed heating element cables are electrically and mechanically connected to electric power supply means, inclusive of power supply cables. Preferably, the heating elements and supply cables are both spoolable cables and are coiled on spooling means for running elongated elements into a well.

In operating the present invention the heating elements are positioned adjacent to the interval of earth formations to be heated and are isolated from contact with fluid flowing into or out of the earth formations. The so-positioned heating elements are then operated to heat the earth formation at said selected temperature between about 600° to 1000° C. Because of the isolation from contact with the flowing fluid and the very high temperature of the heating operation, substantially all of the heat generated by the heating elements radiates from them to a fluid impermeable material and is conductively transmitted through both that material and the adjacent earth formations, with only an insignificant amount of heat being removed from the heating elements by a convective heating process in which molecules of fluid become heated and then move away and carry off the heat.

Such an isolation of the heating elements is preferably effected by surrounding them with fluid impermeable materials such as the wall of a well casing which is closed below the heater by tightly sealed threads or welds or is extended below the heated interval and closed by embedding the end of the casing in cement and/or cementing in a check valve, cement shoe or the like on the bottom of the casing in a location far enough from the heater to avoid any thermally-induced cracking of the cement.

BRIEF DESCRIPTION OF THE DRAWINGS

FIG. 5 is a three-dimensional illustration of an arrangement for interconnecting the bottom ends of a pair of heating element conductors of the present invention.

FIGS. 6 and 7 are diagrammatic illustrations of power circuit configurations suitable for use with the present invention.

DESCRIPTION OF THE INVENTION

Figure 1:
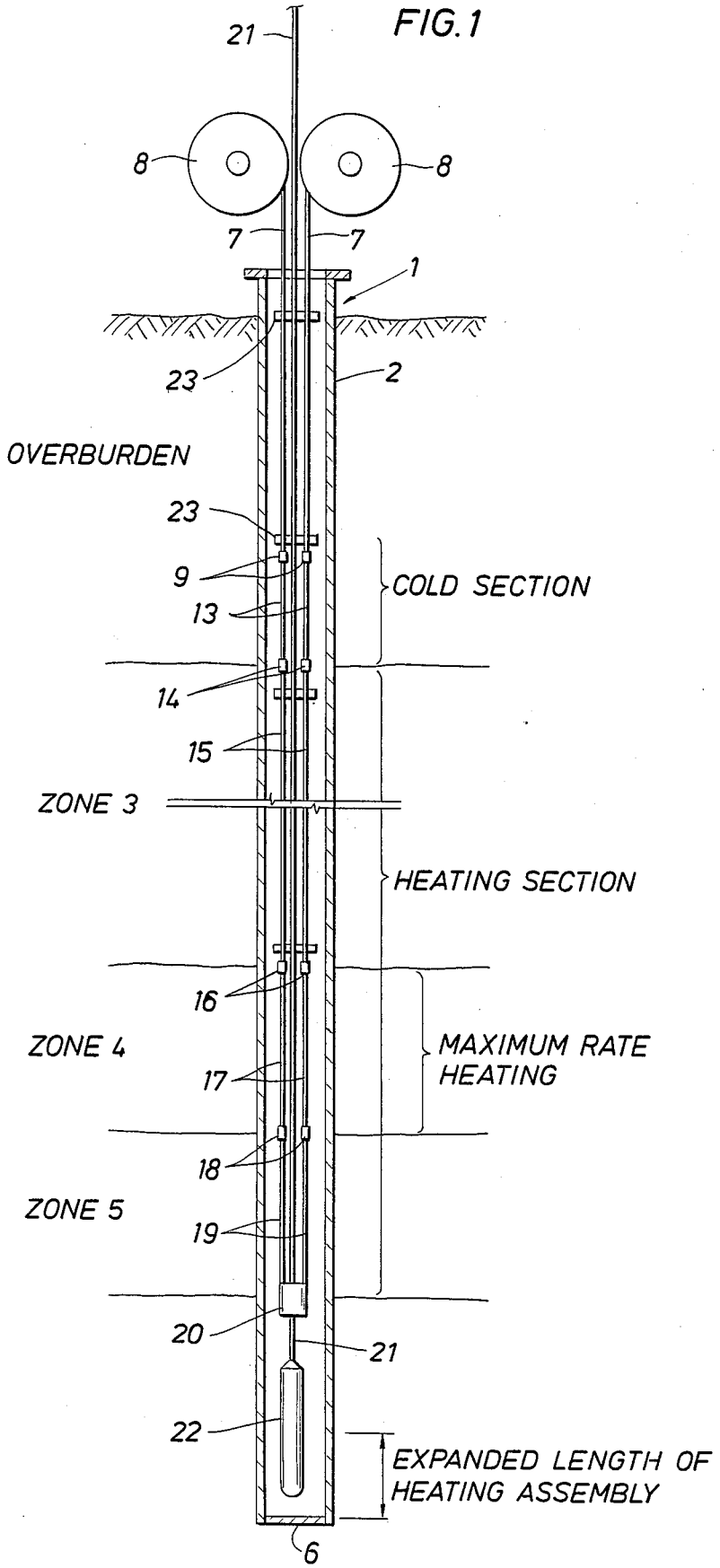
FIG. 1 is a schematic illustration of a heater of the present invention being installed within a well.

As far as applicants are aware, the problems of how to accomplish high temperature heating of subterranean intervals which are longer than several hundred feet, are heated at rates of more than 100 watts/foot, and are heated at temperatures at or near the softening or melting temperatures of numerous materials, have remained unsolved for many years. However, applicants have now discovered that such an operation can feasibly be accomplished by an electrical heater having a combination of elements such as those specified above.

For example, another heater having a different arrangement of structural features more closely resembling those described in the prior art failed within about 2 days when heated at 450° C. A different spoolable heater was constructed with heating elements consisting of two parallel strips of 316 stainless steel, each having dimensions of a width of about 1-inch and a thickness of about 1/16-inch. The heating elements were separated by small blocks of heat resistant electrical insulators spaced every 3 feet along the length of the heater. Such a construction was expected to provide a spoolable heater that could be manufactured economically in lengths of several hundred feet and could generate power of more than 100 watts/foot at an applied EMF of less than 1200 volts.

The so-constructed heater was cemented within an open borehole, using a commercially available heat resistant cement of a type designed for use in oil wells. The cement was expected to isolate the heating elements from contact with fluid flowing into or out of the surrounding earth formations. But, when tried, this heater failed rapidly because ground water penetrated the cement through fractures. Although the water evaporated, it left a salt deposit which finally formed a salt bridge creating an electrically conductive path and causing heater failure either by short circuit or by chemically induced corrosion or both. In view of this it seems likely that, in a hydrocarbon bearing formation such a heater would fail quickly, even in the absence of water, because of coke formation and subsequent short circuiting of the current carrying elements.

In contrast, a heater with a length of 20 feet, constructed in accordance with the present invention and surrounded by a well casing which was sealed at the bottom, was heated at 600° C. and has been operated successfully for 6 months.

In a preferred embodiment of the present invention the uphole ends of the steel sheathed heating element cables are connected to heatstable similarly insulated and steel sheathed cables containing cores having ratios of cross-sectional area to resistance making them capable of transmitting the current flowing through the heating elements in response to said selected EMF while generating heat at a significantly slower rate. Such heat-stable "cold section" cables are preferably spliced to at least the ends of the heating element cables nearest the surface location (e.g., the "uphole" ends) and extended through the borehole for a distance sufficient to reach a "cold" location at a temperature significantly lower than both the temperature of the heated zone and the softening point of the structural materials in the power supplying cables. In such a cold location the cold section cables are preferably spliced to power supply cables. Such power supply cables are preferably copper sheathed, mineral insulated, and copper cored, and have cross-sectional areas large enough to generate only an insignificant amount of heat while supplying all of the current needed to generate the selected temperature in the heated zone.

For use in the present invention splices of the cores in cables in which mineral insulations and metal sheaths encase current conducting cores, are preferably surrounded by relatively short lengths of metal sleeves enclosing the portions in which the cable cores are welded together (or otherwise electrically interconnected). Such electrical connections should provide joint resistance at least as low as that of the least electrically resistive cable core being joined. Also, an insulation of particulate material having properties of electrical resistivity, compressive strength and heat conductance at least substantially equalling those of the cable insulations, is preferably compacted around the cores which are spliced.

FIG. 1 shows a well 1 which contains a casing 2 and extends through a layer of "overburden" and zones 3, 4 and 5 of an interval of earth formation to be heated.

Casing 2 is provided with a fluid-tight bottom closure 6, such as a welded closure, and, for example, a grouting of cement (not shown) such as a heat-stable but heat-conductive cement.

The well completion arrangement used in the present process should provide a means for ensuring that substantially all heat generated in the borehole of the well conductively heats the surrounding earth formations. This is accomplished by preventing any flow of fluid between the surrounding earth formations and the heating elements. The heating elements are surrounded by an impermeable wall, such as a well casing, which is sealed below the heating elements. Isolating the heating elements from contact with fluid flowing into or out of the adjacent earth formations places them in an environment substantially free of heat transfer by movement of heated fluid. Therefore, the rate at which heat generated by the heating elements is removed from the borehole of the well is substantially limited to the rate of heat conduction through the earth formations adjacent to the heated portion of the well.

As seen from the top down, the heater assembly consists of a pair of spoolable electric power supply cables 7 being run into the well from spools 8. Particularly suitable spoolable cables consist of copper conductors insulated by highly compressed masses of particles of magnesium oxide which insulations are surrounded by copper sheaths; the MI power supply cables available from BICC Pyrotenax Ltd. exemplify such cables.

Figure 2:
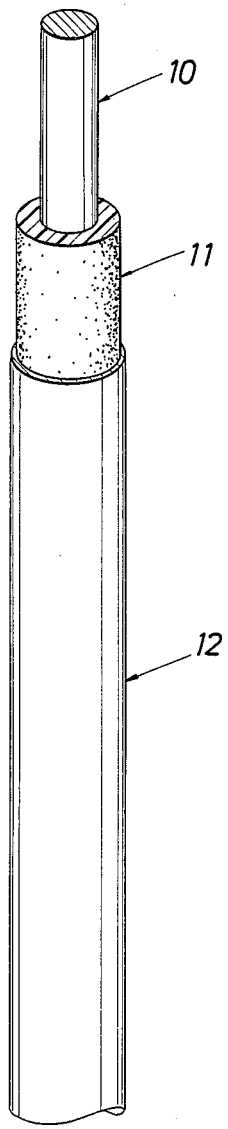
FIG. 2 is a three-dimensional illustration of an insulated and sheathed heating element of the present invention.

FIG. 2 shows a preferred structural arrangement of an electrically conductive strand surrounded by a compressed mineral insulation that is covered by a metal sheath. Electrically conductive core 10 is surrounded by an annular mass of compressed mineral insulating material 11 which is surrounded by a metal sheath 12. For use in the present invention, the diameter and thickness of the sheath is preferably small enough to provide a cable which is "spoolable", i.e., can be readily coiled on and uncoiled from spools without crimping the sheath or redistributing the insulating material. The diameter of the electrically conductive strand within the cable can be varied to allow different amounts of current to be carried while generating significant or insignificant amounts of heat.

Figure 3:
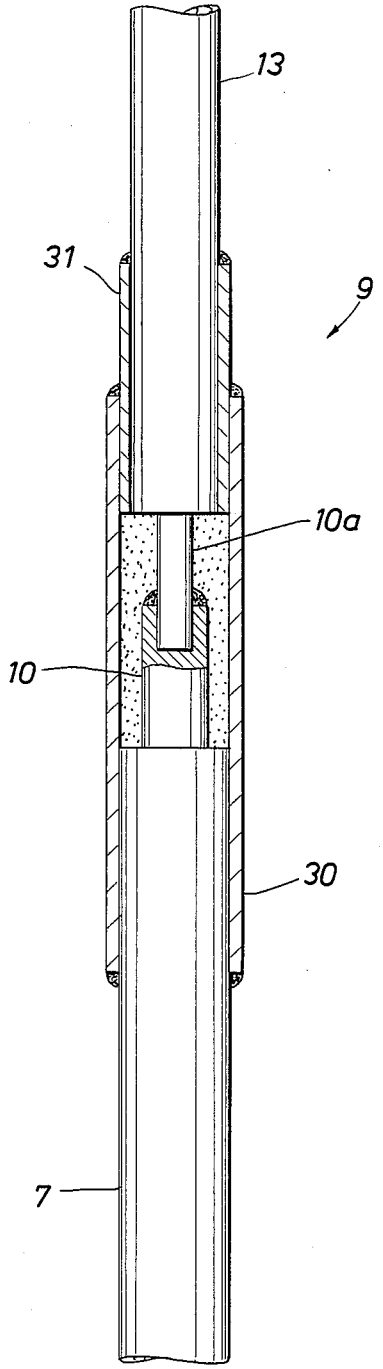
FIGS. 3 and 4 are illustrations of splices of copper and steel sheathed cables suitable for use in the present invention.

As shown in FIG. 1, splices 9 connect the power cables 7 to heat-stable "cold section" cables 13. The cables 13 provide a cold section above the "heating section" of the heater assembly. (Details of the splices 9 are shown in FIG. 3.) The cold section cables 13 as well as the power cables to which they are spliced are preferably spoolable cables constructed as shown in FIG. 2. The cold section cables 13 each have an external sheath which has a diameter near that of the power cable but is constructed of a steel, which preferably is or is substantially equivalent to a stainless steel such as 316 stainless steel. Relative to the power cables, the conductors or cores of cold section cables 13 preferably have cross-sections which are smaller but are large enough to enable the cold section cables to convey all of the current needed within the heating section without generating or transmitting enough heat to damage the copper or other sheaths on the power cables or the splices that connect them to the cold section cables. This forms a warmed but not significantly heated cold section providing a stepwise decrease from the temperature attained in the heating section.

Figure 4:
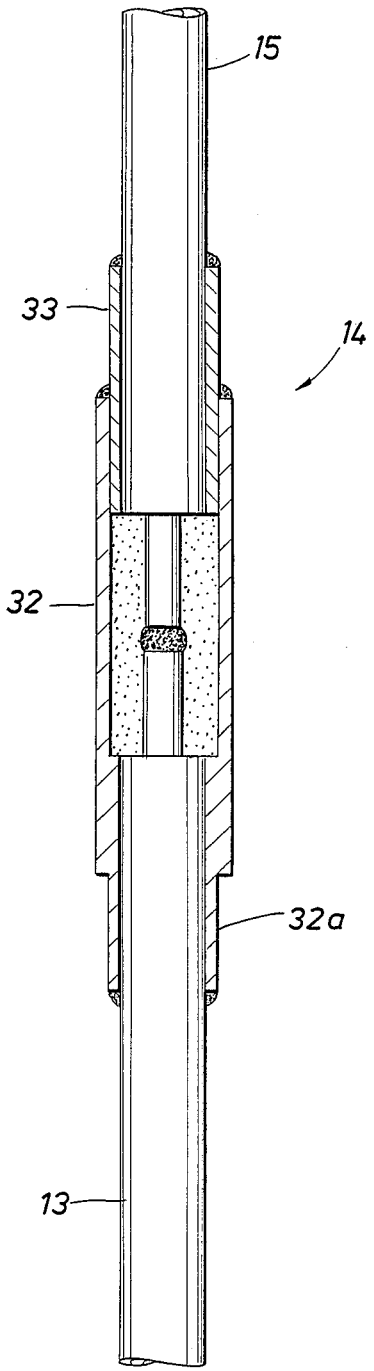

At splices 14 the cold section cables 13 are connected to moderate-rate heating-element cables 15. (Details of the splices 14 are shown in FIG. 4.) In the moderate-heating-rate cables 15 the cross-sectional area of a core such as a copper core is significantly smaller than the core of the cold section cable 13. In each of the cables 15, the relationship between the cross-sectional area of the current carrying core and the resistance of that core is preferably such that each cable 15 generates a selected temperature between about 600° to 1000° C. while heating at a rate of more than about 100 watts per foot in response to a selected EMF of not more than about 1200 volts between the cores and sheaths. Of course, where desired, the cables located along different earth formations in a given interval to be heated can include numerous gradations of higher or lower rates of heating.

At splices 16 the moderate-rate-heating cables 15 are joined with maximum-rate heating cables 17 (relative to the situations illustrated). The constructions of the cables 15 and 17 and splices 16 and 18 are the same except that the cables 17 contain electrically conductive cores having smaller cross-sectional areas for causing heat to be generated at a rate which is somewhat higher than the moderate rate generated by cables 15 in response to a given EMF.

Splices 18 connect the maximum rate heating cables 17 to moderate rate heating cables 19. Splices 18 can be the same as splices 16 and cables 19 can be the same as cables 15.

At the end-piece splice 20 the current conducting cores of the cables 19 are welded together within a chamber in which they are electrically insulated. (Details of the end-piece splice 20 are shown in FIG. 5.)

The end-piece splice 20 is mechanically connected to a structural support member 21 which is weighted by a sinker bar 22. The support member 21 is arranged to provide vertical support for all of the power and heating cable sections by means of intermittently applied mechanical connecting brackets 23.

In the situation shown in FIG. 1, the section of underground earth formation to be heated contains zones 3, 4 and 5, having different heat conductivities. Zones 3 and 5 have similar heat conductivities but that of zone 4 is significantly higher.

As known to those skilled in the art, the existence and locations of anomalous layers or zones within an interval of underground formations can be detected by numerous known procedures. For example, a well filled with fluid such as a drilling mud can be allowed to attain a temperature equilibrium after which measurements can be made of the pattern of temperature with depth within that fluid and/or the adjacent rocks. Such a pattern of temperature is indicative of the pattern of heat conductivity with depth along the interval of earth formations adjacent to the well. Density logs, sonic velocity logs, and electrical conductivity logs, logs of the composition with depth of formations around the well, and the like kinds of measurements can also be utilized to determine the pattern of heat conductivity within the near well portion of the interval of earth formations to be heated. As is also known, such determinations are based on measurements of an average property existing in or along an interval which is as long as the minimum detection distance of the measuring tool. Thus, the patterns of variations with distance along a borehole interval usually reflect only the average values of a property along intervals of about 2 to 10 or more feet in length.

As shown in FIG. 1, where the interval of earth formations to be heated contains a relatively highly heat conductive zone, such as zone 4, the anomaly should be compensated for by, for example, splicing in a section of cables having relatively small diameters, such as cables 17. Alternatively, or additionally, at least one extra heating cable, for example having the same core cross-sectional area and heating rate as cable 15, could be positioned along a zone of high heat conductivity such as zone 4. Such adjustments should vary the total cross-sectional area of heating cable cores in relation to the varying heat conductivities of the adjacent earth formations so that rate of heat generation is substantially the same at all points opposite the earth formations.

Where the heating of an inhomogeneous interval is to be continued for a significantly long time it may be advantageous to start heating with an electrical heater of the present type in which the relative heating rate has not been increased along a highly heat conductive zone (such as zone 4) by as much as the relative heat conductivity of the earth formations in that zone have decreased below the average heat conductivity of the total interval to be heated. Then, after a time that is not significant relative to the total heating time, the rate of heating along the highly heat conductive zone can be increased, for example, by installing an additional heating cable to supplement the output of a heating cable that was initially installed.

If the interval to be heated contains a zone of anomalously low heat conductivity, that zone should be bridged by a section of heat stable current transmitting cable, such as cable 13, arranged to provide a reduced rate of heat generation which matches, or compensates for, the low rate of heat conductivity, so that the tendency for the temperature to increase (due to the slower removal of heat from the borehole) does not cause an undesirable escalation of the temperature. At least one heat stable power transmitting cable, such as cable 13 having a relatively large core cross-sectional area should be used to carry the current for the heating section past any portion of heated zone which is uphole from a zone which is to be heated at a lower rate.

Consider a heating cable of the present invention with a copper core. Where the core diameter is constant its resistance per unit length is constant. In a homogeneous environment the cable would generate heat at the same rate all along its length. But, in a well borehole along an interval of earth formations containing a layer having a heat conductivity lower than the average, the temperature would rise along that layer, because of the relatively slow removal of heat. That temperature increase would increase the resistance of the copper core and thus might increase the rate of heating. Such a location could become a temperature-escalating "hot-spot" along the heater.

In the above situation, in accordance with the present invention, the heating cable core diameter would be adjusted to have an enlarged diameter along the location that becomes adjacent to the layer of low heat conductivity. In a homogeneous environment the so-adjusted portion would heat at a slower rate and develop a lower temperature. But, in a borehole adjacent to a low conductivity layer (with a correct adjustment) the heating rate of the adjusted portion would increase as the temperature increased. Then at a temperature slightly higher than that in other portions of the borehole the rate of heat generation would become substantially equal to that in other portions of the borehole while the generated heat was being removed through the adjacent layer of earth formation of relatively low heat conductivity.

In general, localized zones of heat conductivity that differ from the average by amounts up to about 30% can be easily compensated for within an interval of subterranean earth formations being heated. This can be accomplished by heating cable core cross-sectional area adjustments of up to about 10–15% and/or equivalent adjustments of combinations of heating cable core cross-sectional areas and resistances. Along a layer of earth formation having a heat conductivity of, for example, 20% less than the average along the interval to be heated, the total resistance per unit distance of the adjacent heater should be less than the average along the total interval. It should be less by enough so that, at a temperature of about 20% above the average heating temperature along the total interval, the heat induced increase in heater resistance along the layer of low heat conductivity would cause the rate of heating along that layer to approximate the average rate along the total interval being heated.

In the present process the temperature gradient from within the borehole to within the formations to be heated is a driving force affecting the rate at which heat is moved into the earth formations. Thus, the temperature gradient is analogous to the pressure gradient acting as a driving force in a water drive process. But, in the present process, the correlation between the pattern of electrical resistance with distance along the heater and the pattern of heat conductivity with distance along the interval being heated provides a unique advantage which would be desirable but is unattainable in a water drive. In the present process, in layers of low heat conductivity, the gradient is increased by the increase in heater temperature. In a water drive, although it would be desirable to increase the gradient along the layers of low permeability, no way has been found to do so. In the present process, the provision of an increased gradient along the less heatconductive layers tends to improve the uniformity of the advance of the heat into the earth formation being heated.

FIG. 3 illustrates details of the splices 9. As shown in the figure, the power cable 7 has a metal sheath, such as a copper sheath, having a diameter which exceeds that of the steel sheathed cold section cable 13. The central conductors of the cables are joined, preferably by welding. A relatively short steel sleeve 30 is fitted around, and welded or braised to, the metal sheath of cable 7. The inner diameter of sleeve 30 is preferably large enough to form an annular space between it and the steel sleeve of cable 13 large enough to accommodate a shorter steel sleeve 31 fitted around the sheath of cable 13. Before inserting the short sleeve 31, substantially all of the annular space between the central members 10 and **10*a* and sleeve 30 is filled with powdered mineral insulating material such as magnesium oxide. That material is preferably deposited within both the annular space between the central members and sleeve 30 and the space between sleeve 30 and the sheath of cable 13 and is preferably vibrated to compact the mass of particles. Sleeve 31 can also be driven into the space between sleeve 30 and the sheath of cable 13 so that the mass of mineral particles is further compacted by the driving force. The sleeves 30 and 31 and the sheath of cable 13** are then welded together.

FIG. 4 illustrates details of the splices 14, which are also typical of details of other splices in the steel sheathed heating section cables, such as splices 16 and 18. The splice construction is essentially the same as that of the splices 9. However, the steel sleeve 32 is arranged, for example, by machining or welding to have a section 32*a* with a reduced inner diameter which fits around the sheath of cable 13 and a larger inner diameter which leaves an annular space between the sleeve 32 and the sheath of cable 15. After welding the central conductors together, the sleeve portion 32*a* is welded to the sheath of cable 13. The annular space between the sleeve 32 and the central conductors is filled with powdered insulating materials, a short sleeved section 33 is driven in to compact particles and is then welded to the sheath of cable 15.

FIG. 5 illustrates details of the end splice 20. As shown, cables 19 are extended through holes in a steel block 20 so that short sections 19*a* extend into a cylindrical opening in the central portion of the block. The electrically conductive cores of the cables are welded together at weld 34 and the cable sheaths are welded to block 20 at welds 35. Preferably, the central conductors of the cables are surrounded by heat stable electrical insulations such as a mass of compacted powdered mineral particles and/or by discs of ceramic materials (not shown), after which the central opening is sealed, for example, by welding-on pieces of steel (not shown). Where the heater is supported as shown in FIG. 1, by attaching it to an elongated cylindrical structural member 21, a groove 36 is preferably formed along an exterior portion of end splice 20 to mate with the structural member and facilitate the attaching of the end piece to that member.

In general, the power supplying elements can comprise substantially any AC or DC systems capable of causing a heater of the present type to heat at a relatively high rate, such as at least about 100 watts per foot.

Figure 7:
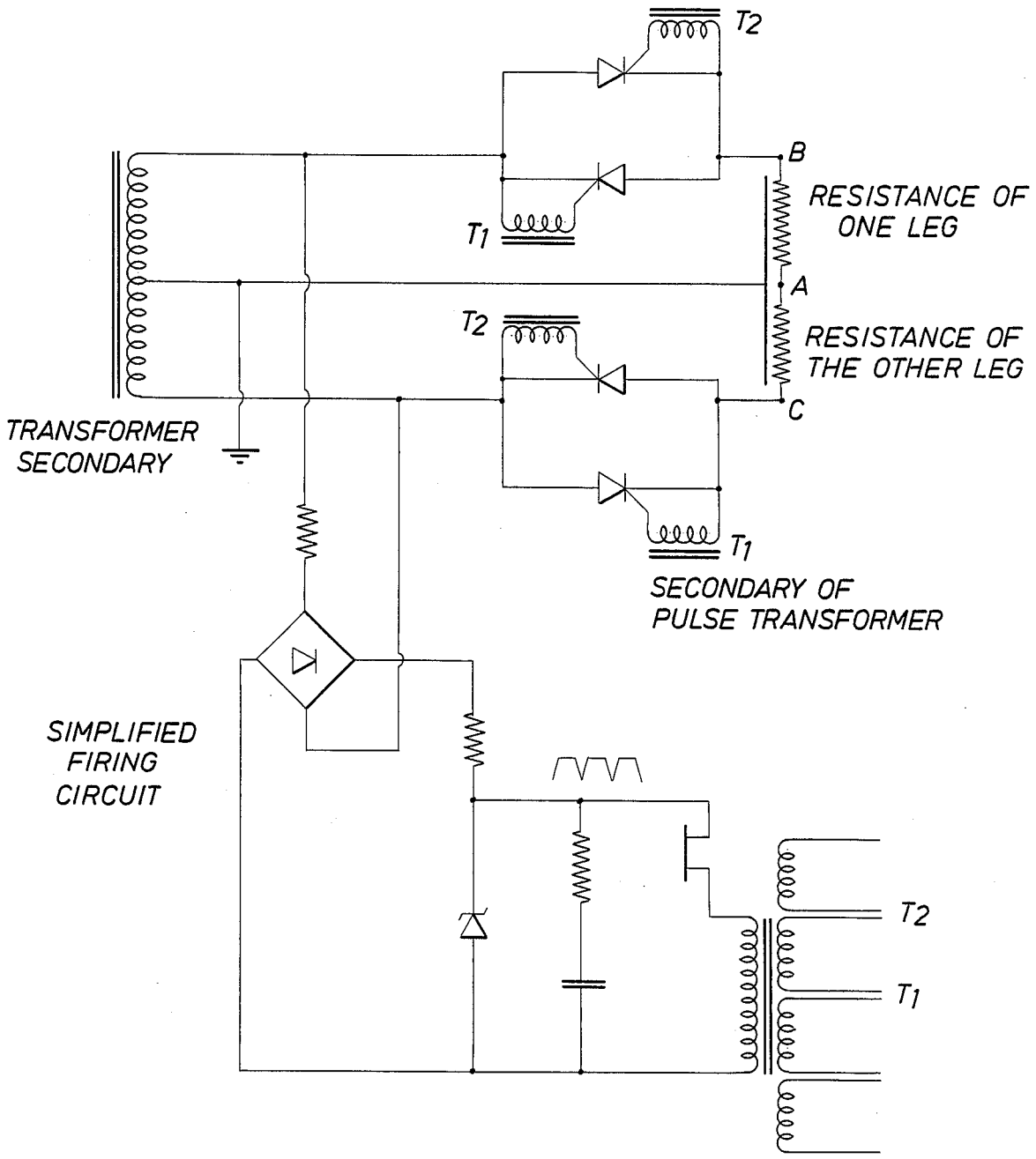

FIGS. 6 and 7 are diagrams of a preferred arrangement of electrical power supplying elements for the present type of heater. As shown in FIG. 6, such an arrangement includes two inverse, parallel, silicon controlled rectifiers (SCRs) in the circuits of both elements of a two-element heater. Although in principle one set of SCRs would be sufficient, using a similar set in the other element or leg has a unique advantage. Consider the diagram of FIG. 7. First, assume the SCRs to be turned "full on". Across the resistors AB and AC representing the legs of the heater, will be 480 root-mean-square volts of alternating current with each leg of the heater receiving half of this. When point B swings up to plus 240 V, point C is at minus 240 V and vice versa. Since this is a balanced system and the heater legs are of equal resistance, point A will remain at zero voltage or virtual ground potential. The sheaths of the heater cables are connected to the grounded center tap of the transformer secondary. Since point A represents the welded connection in the end piece 20, the potential difference between the connection and the housing will be zero for all practical purposes. These points could be in electrical contact without any conduction of current. At points advancing upward along the legs of the heater, the potential difference between the sheaths and the central conductor increase and finally reach maximums of plus or minus 240 V.

By using the dual set of SCRs and the zero voltage switching mode, this condition can also be maintained during partial control. with zero voltage switching, the power supply is either full-on or full-off. Each SCR in an inverse parallel circuit will conduct for one complete half-cycle beginning at the zero voltage point. The resulting output is then a full cycle or full wave control. Time proportioning of the output is accomplished by a time base or sample period during which the two SCRs pass increments of one or multiple cycles, and this stage is no different from full-on.

It is during the increments of no conduction that the advantage of the second pair of SCRs comes into use. A single pair of SCRs in one leg can be used for switching the current in the circuit. However, when only a single pair is used, through the other leg, the heater remains connected to one end of the transformer and since that point swings up and down between plus and minus 240 volts, so will the entire heater including point A. On the other hand, with SCR switches in both legs, the entire heater will be electrically disconnected from the transformer secondary during the full-off periods and will remain floating at the last potential at which it was when the circuit was cut off, and that potential was zero volts.

When a well heater is emplaced in a borehole and operated at a temperature of more than about 600° C., loading (i.e., weight/cross-sectional area of weight-supporting elements), thermal expansion, and creep, are three factors which play an important role in how the heater can be positioned and maintained in position (for any significant period of time). For example, for a heater constructed and mounted as illustrated in FIG. 1, where the central structural member 21 is a stainless steel tube having an inner diameter of one-half inch and an outer diameter of 11/16ths inch, since the coefficient for thermal expansion for both steel and copper is about 9 times $10^{-6}$ inches per inch, per degree Fahrenheit, a 1000-foot long heating section would expand to 1013 feet by the time it reached a temperature of 800° C.

When using the arrangement illustrated in FIG. 1, space is preferably allowed for such expansion. The heater is preferably positioned so that, after expansion, the lower part is carrying its weight under compression loading (because it is resting on the bottom of the borehole or surrounding casing) while the upper part is still hanging and is loaded under tension, with a neutral point being located somewhere in the middle.

Due to the creep rate of stainless steel, with a typical loading factor of about 7000 psi on stainless steel structural members of a heater, at 700° C. the length of a 1000-foot heating section would increase by 0.012-inch per hour or 105 inches per year or 87.5 feet in 10 years—if it was not ruptured before then.

Figure 8:
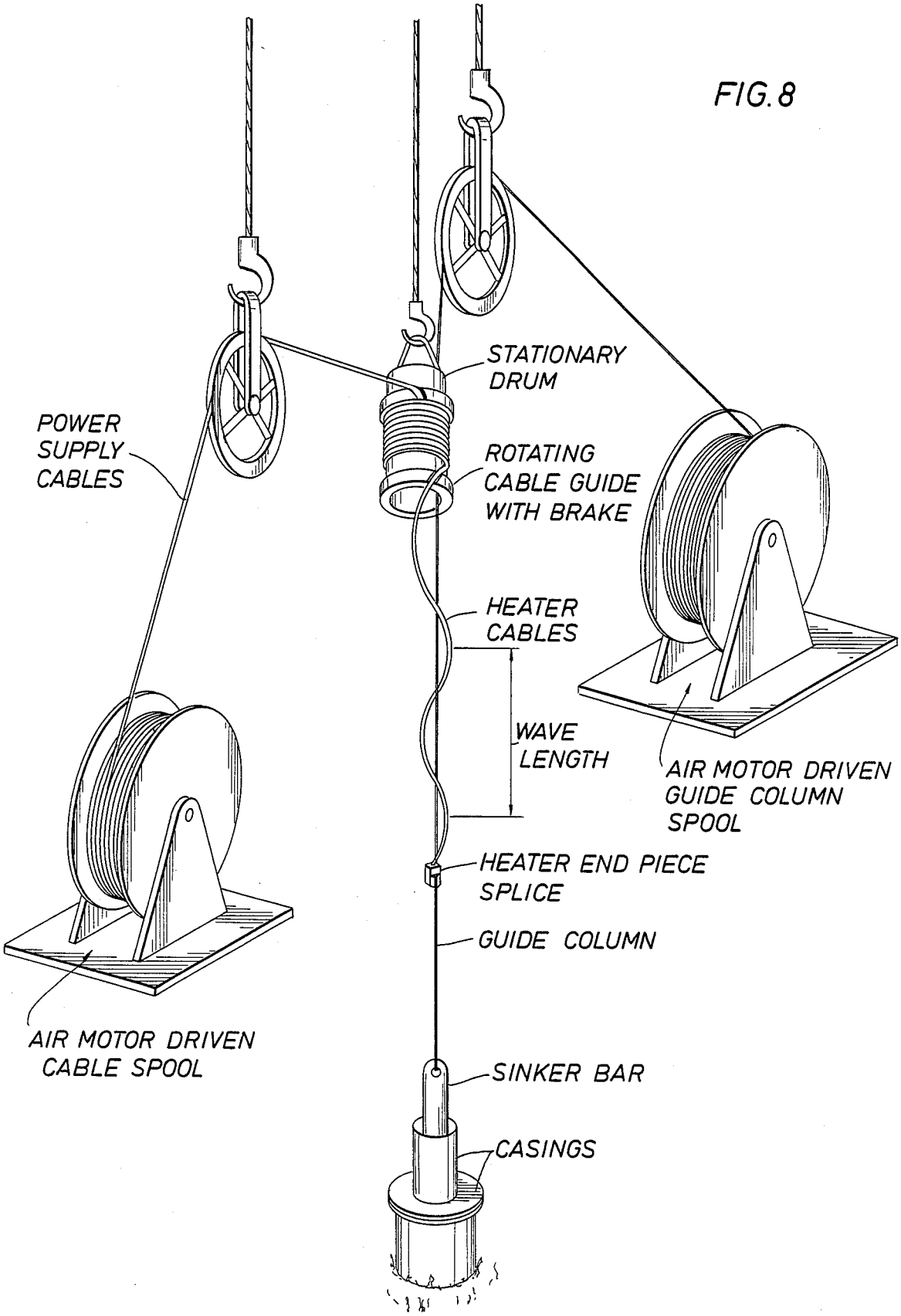
FIG. 8 is a schematic illustration of an alternative method of installing a heater of the present invention within a well.

FIG. 8 illustrates an emplacement procedure that all but eliminates the problems due to loading, thermal expansion and creep. As shown, a pair of heating cables (such as cables 15 of FIG. 1) long enough to form a spiral extending through the zone to be heated are coiled around a stationary drum with: (a) their downhole ends joined by a heater end piece splice (such as end splice 20 of FIG. 1) which is connected to a spool-wound guide column or carrying member (such as number 21 of FIG. 1) and (b) their uphole ends connected to power supply mineral insulated cables (such as cables 7 of FIG. 1) wound on a cable spool. The stationary drum on which the heater cables are wound is supported so that it surrounds the guide column. The guide column is drawn by a sinker bar (e.g. bar 22 of FIG. 1) into a well casing. As the guide column or carrying member is lowered, turns of the heater cables are pulled from the stationary drum so that they spiral around the carrying member. The heater cables are attached to the carrying member only at the location of their end splice.

As the carrying member is lowered, the heater coils are pulled off the stationary drum and stretched to an extent such that they can freely enter into the casing. In such a procedure, when the lowering of the carrying member stops, some of the tension in the heater coils is released and the coils press themselves against the casing wall. This causes the coils to be supported by friction against the casing wall so that their weight is supported and the remaining loading is practically zero. When the lowering of the carrying member is resumed the heater coils are released from the casing wall in sequence from the bottom up.

In removing the heater from the well, pulling the heater cables up more rapidly than the carrying member is raised releases the cable coils, in sequence, from the top down, so that the whole assembly can be released and recovered.

The wave length or frequency of the heater coils, i.e., the distance between equal portions of the helix as shown on the figure, is determined by the diameter of the stationary drum and the inner diameter of the casing. Where the coils have a wavelength of about 2 feet it takes about 12 feet more than 1000 feet to insert the coils within a 1000-foot long section of 2½-inch inner diameter casing.

Since this coiled heater cable installation procedure allows for very little thermal expansion or creep, the compressive force due to expansion will cause the metal components of the cable to expand. For example, this may cause an increase such as 0.0004-inch on each 0.030-inch of copper or steel structural member within the cable. Since tension loading on the structural members is avoided by the wall friction on the turns there is little tendency for any creep to occur.

Applicants have found that though copper melts at 1080° C. and softens at much lower temperatures—and has very little creep resistance at any temperature—it can comprise a preferred current carrying cable core for use in the present invention. When a copper core is surrounded by a compacted mass of powdered mineral insulation (such as magnesium oxide) within a steel sheath, the insulator and sheath confine and immobilize the central copper core. Even where the core is a cylindrical wire of 3 mm in diameter, it can safely be heated to a temperature exceeding 800° C. Its life expectancy at 800° C. is expected to be at least several years. In a cold section of steel sheathed cable a 4.2 mm cylindrical copper core extending about 40 feet away from a section being heated at 800° C. provides a temperature of less than 200° C., which is well below the liquefying temperature of a suitable solder (around 600° C.). In a copper sheathed spoolable power supply cable a copper core 0.325 inches (8.25 mm) can readily provide the power for the high temperature heating section while generating only an insignificant amount of heat.

In general, the central electrical current conductor or coil of the heating coils used in the present invention at from about 600° to 1000° C. can comprise substantially any pure metal or alloy having a resistivity of less than about 50 microhm-centimeters at 800° C. Particularly suitable core materials comprise substantially pure (e.g., at least about 99%) copper or nickel (with the nickel core having a larger effective diameter, e.g., a diameter of about 3/16-inch where a 2/16-inch diameter of copper would suffice) or the alloy known as chromium-copper.

Since the temperature coefficient of resistivity of good electrical conductors, such as pure copper or nickel, is significantly high, if a hot spot occurs along the heater, the hot spot resistivity increases and the higher resistivity leads to higher and higher temperatures. Such a tendency for the temperature to rapidly escalate in any hot spot located along the length of any heating section is, of course, magnified in a situation where, in effect, the only way for heat to be removed from around the heating element is by conduction through the adjacent earth formations. Such earth formations may have rates of heat conductivity about as low as those of fire brick. Therefore, in the present process, the determinations of the pattern of heat conductivity of the near well portion of the formations to be heated is important. Such information allows the total cross-sectional areas of the current conducting cores of the heating sections to be arranged to compensate for localized low formation heat conductivities which would tend to yield hot spots or localized high formation heat conductivities which would tend to cause lower temperatures to be developed and less heat to be injected along those sections.

In general, a central weight carrying member or guide column member suitable for use in the present invention can be substantially any metallic tube or chain, or the like, which is capable of being inserted into a well borehole along with the heater for carrying the weight of the heater. In a preferred embodiment, the central weight carrying structural member (such as member 21 of FIG. 1) can advantageously be a load and heat resistant spoolable tubing of stainless steel. Such a tube can advantageously have substantially any dimensions compatible with the diameter of the well borehole and heater installation method to be used. The boreholes are preferably relatively slim and the heater and the power supplying cables are preferably installed by running them in from spools. The weight carrying members preferably have spoolable dimensions such as not more than about 1-inch in diameter or ⅛-inch in wall thickness.

By equipping a wellhead with a lubricator to seal around a strand or wire run through a heat resistant tubing which is used as a weight carrying member, a measuring unit such as a thermocouple can be run in through the weight carrying member to log the temperature along the section being heated. In addition, by including an opening near the bottom of such a weight carrying tubing, an atmosphere of inert gas such as nitrogen or argon can be inflowed and/or maintained within a closed casing (such as casing 2 of FIG. 1) in order to ensure that the heating elements are surrounded by noncorrosive atmospheres.

What is claimed is:

1. A process for heating a significantly long interval of subterranean earth formations, comprising:

constructing at least one electrical heating cable consisting essentially of (a) an electrically conductive central core having a relatively low electrical resistance, (b) an insulation around said core comprising a compressed mass of solid particles of electrically nonconductive, heat-stable material, and (c) a metal sheath around said core and insulation having significant softening resistance and tensile strength;

arranging at least one of said heating cables to provide a heater capable of (a) being extended throughout the interval to be heated, and (b) generating selected temperatures between about 600° to 1000° C. in response to a voltage which is less than the sparking potential of the insulation between the core and sheath;

arranging a pattern with distance along said heater of combinations of heating cable core cross-sectional areas and heating cable core resistances which pattern is correlated with the pattern of heat conductivity with distance which exists along said interval of earth formations to be heated, so that localized increases and decreases in the average electrical resistance with distance along the heater have magnitude and relative positions similar to those of localized increases and decreases in the heat conductivity in the adjacent earth formations in a manner capable of resulting in a substantially uniform rate of heat injection into the earth formations;

positioning said heater within the borehole of a well so that the heater is both located along the interval of earth formations to be heated and isolated from contact with fluid flowing into or out of the earth formations to be heated; and operating the heater by applying a voltage sufficient to generate temperatures of about 600° to 1000° C. along the heater to effect said substantially uniform rate of heat injection.

2. The process of claim 1 in which the interval to be heated is at least several hundred feet long.

3. The process of claim 1 in which the heater is positioned within a well casing which is fluid-tightly closed around the heater.

4. The process of claim 1 in which said heating cables are spooled and run into the well from at least one spooling means.

5. The process of claim 1 in which said heater contains at least one section along its length in which the resistance per length is different from said resistance in at least one other section of the heater.

6. The process of claim 1 in which the rate of heating in at least one portion of the interval to be heated is increased by positioning at least one additional heating cable in parallel to at least one other heating cable.

7. The process of claim 1 in which at least one cold section cable, having an electrically conductive core which is mineral insulated and metal sheathed and contains a combination of cable core cross-sectional area and cable core resistance arranged to generate less heat for a given applied voltage than that generated by said heating cables, is connected to extend between the uphole end of at least one heating cable within said heater and a relatively cold zone within the well borehole and is there connected to a power supply cable.

8. The process of claim 1 in which said electrical heating cables are spoolable and contain (a) an electrically conductive core having an electrical resistance at least substantially as low as substantially pure copper (b) an insulation around said core having properties of electrical resistance, compressive strength and heat conductivity at least substantially equalling those of a compressed mass of powdered magnesium oxide and (c) a metal sheath around said core and insulation having a diameter and wall thickness capable of providing properties of tensile strength, creep resistance and softening temperature at least substantially equalling those of 316 stainless steel.

9. The process of claim 8 in which said heater is constructed to contain at least one cold section cable having an electrically conductive core which is mineral insulated and metal sheathed and contains a combination of cable core cross-sectional area and cable core resistance arranged to generate less heat for a given applied voltage than that generated by said heating cables is connected to extend between the uphole end of at least one heating cable within said heater and a relatively cold zone within the well borehole and is there connected to a power supply cable.

10. The process of claim 9 in which said heater is constructed to contain at least one portion in which the resistance per unit length due to the combination of the cable core cross-sectional area and cable core resistance is different than such resistance in another portion of the heater.

11. The process of claim 1 in which said heater is arranged by splicing at least one heating cable to at least one other cable so that:

the core of the heating cable is electrically connected to the core of another mineral insulated and metal sheathed cable so that the electrical conductivity through the connection is at least as high as that of the least conductive one of the connected cable cores;

said heat resistive metal sheath of the heating cable is welded to a tube of at least substantially equally heat sensitive metal which extends around the connection of the cable cores and around a portion of the sheath of the cable to which the heating cable is spliced;

compactable particles of mineral insulating material are dispersed in a relatively dense mass within said tube and the space between the tube and the sheath of the cable to which the heating cable is connected; and a second tube of metal which is the same or substantially equivalent to that of said first tube is forced into the annular space between the first tube and the sheath of the cable to which the heating cable is connected, so that the mass of particles surrounding the cable cores is further compacted, and is there welded or braised to the sheath it surrounds.

12. A well heater comprising:

at least one electrical heating cable which contains an electrically conductive core of metal having a relatively low electrical resistance, a core-surrounding insulation of compacted particles of mineral having a relatively high heat stability and electrical resistance and, surrounding the core and insulation, a sheath of metal having relatively high heat stability and tensile strength;

at least one heating section which (a) is capable of extending for at least several hundred feet within an interval of well borehole adjacent to an interval of subterranean earth formation to be heated, (b) contains at least one of said electrical heating cables, and (c) contains combinations of heating cable core resistances and core cross-sectional areas capable of producing within said heating section selected temperatures between about 600° and 1000° C. while heating at a rate of at least about 100 watts per foot of power in response to a selected voltage between said cable core and sheath elements which is less than the dielectric strength of said insulation;

at least one cold section which contains at least one heat stable cable in which the core, insulation and sheath materials are at least substantially the same as those in said heating cable but the combination of core cross-sectional area and resistance generates significantly less heat per applied voltage than said heating cables, said cold section being connected to supply electrical power to the heating cables from an uphole location far enough removed from the heating cables to have a temperature significantly lower than that near the heating cables;

means for supporting the heating cables so that they are positioned adjacent to the earth formations to be heated and are kept isolated from any fluid flowing into or out of those formations; and means for supplying electrical power to said heating cables at said selected voltage.

13. The well heater of claim 12 in which the combination of heating cable core cross-sectional areas and resistances are arranged relative to a pattern of heat conductivity with distance along said interval within the earth formations to be heated so that localized increases and decreases in the average electrical resistance with distance along the heater have relative magnitudes and locations correlated with those of localized increases and decreases in the heat conductivity in the adjacent earth formations.

14. The well heater of claim 13 in which said electrical heating cable is spoolable and contains (a) an electrically conductive core having an electrical resistance at least substantially as low as substantially pure copper (b) an insulation around said core having properties of electrical resistance, compressive strength and heat conductivity at least substantially equalling those of a compressed mass of powdered magnesium oxide and (c) a metal sheath around said core and insulation having a diameter and wall thickness capable of providing properties of tensile strength, creep resistance and softening temperature at least substantially equalling those of 316 stainless steel.

15. The well heater of claim 12 in which said heating section contains at least one portion in which the resistance per unit length provided by at least one combination of core cross-section and resistance is different than that in at least one other section.

16. The well heater of claim 12 in which the resistance per unit length provided by the combinations of core resistances and cross-sections are substantially equal throughout the heating section of the well heater.

17. The well heater of claim 12 in which said well heater and associated power supply cables are spoolable cables capable of being inserted into a well borehole by a spooling means.

18. The heater of claim 12 in which the heater contains a pair of said heating cables and said means for supplying electrical power to the heating cables, includes:

a source of alternating current;

a transformer with a grounded center tap to which the sheaths of the heating cables are connected;

each output of the transformer connected to a core of one heating cable through a circuit containing two inverse, parallel, silicon controlled rectifiers arranged so that each will conduct for one complete half-cycle beginning at a zero voltage point; and a silicon controlled rectifier switching circuit connected to initiate zero volt switching of said rectifiers.

19. The heater of claim 18 in which said heating cable cores are electrically interconnected at the downhole end of the interval to be heated.

20. The heater of claim 12 in which at least one of said heating cables contains a splice in which:

the core of the heating cable is electrically connected to the core of another mineral insulated and metal sheathed cable so that the electrical conductivity through the connection is at least as high as that of the least conductive one of the connected cable cores;

said heat resistive metal sheath of the heating cable is welded to a tube of at least substantially equally heat sensitive metal which extends around the connection of the cable cores and around a portion of the sheath of the cable to which the heating cable is spliced;

compactable particles of mineral insulating material are dispersed in a relatively dense mass within said tube and the space between the tube and the sheath of the cable to which the heating cable is connected; and a second tube of metal which is the same or substantially equivalent to that of said first tube is forced into the annular space between the first tube and the sheath of the cable to which the heating cable is connected, so that the mass of particles surrounding the cable cores is further compacted, and is there welded or braised to the sheath it surrounds.

21. A well heating process comprising:

positioning at least one pair of heating cables within a borehole interval which is at least several hundred feet long and is arranged to keep said heating cables isolated from contact with fluid flowing into or out of the earth formation adjacent to said borehole interval;

said heating cables each consisting essentially of a spoolable cable containing a metal electrical current conductor of high electrical conductivity, a compressed mass of non-conductive solid particles surrounding the current conductor within a steel sheath, and being (a) electrically connected to form heating elements of at least one multiple-leg electric heater and (b) provided with combinations of conductor cross-sections and resistances causing said cables to generate selected temperatures between about 600° and 1000° C. in response to a selected EMF of not more than about 1200 volts and (c) arranged to have a pattern of electrical resistance with distance along said borehole interval which is capable of compensating for variations in the pattern of heat conductivity with depth along the earth formation interval adjacent to said borehole interval so that the rate at which heat is injected is substantially uniform throughout that interval;

connecting spoolable power cables between the uphole ends of the heating cables and the terminals of a power supply means, with said power cables having combinations of electrical conductor cross-sections and resistances enabling them to develop insignificant amounts of heat while supplying an EMF at which said heating cables generate said selected temperatures; and operating said heating cables at said selected EMF.

22. The process of claim 21 in which at least a third heating cable is positioned within at least one portion of said borehole interval to form a portion of said combinations of cable conductor core cross-sections and resistances that provide said pattern of electrical resistance with distance along the interval.

23. The process of claim 21 in which the electrical current conductor of high electrical conductivity is a metal of the group copper, nickel or chromium-copper.

24. A well heating process comprising:

positioning at least one pair of heating cables within a borehole interval which is at least several hundred feet long and is arranged to keep said heating cables isolated from contact with fluid flowing into or out of the earth formation adjacent to said borehole interval;

said heating cables each consisting essentially of a metal electrical current conductor of high electrical conductivity insulated by a compressed mass of non-conductive solid particles within a steel sheath, and being (a) electrically connected to form heating elements of at least one multiple-leg electric heater and (b) provided with combinations of conductor cross-sections and resistances capable of generating selected temperatures between about 600° and 1000° C. in response to a selected EMF of not more than about 1200 volts and (c) arranged to provide a pattern of electrical resistance with distance along said borehole interval which is capable of interacting with the pattern of heat conductivity with depth along the earth formation interval adjacent to said borehole interval so that the heat injection rate is kept substantially constant along that interval;

connecting the uphole ends of said heating cables to spoolable steel-sheathed, mineral-insulated, heat-stable cables having combinations of conductor cross-section and resistances per unit length causing them to generate significantly less heat per EMF than said heating cables, with said heat-stable cables extending away from the heating cables far enough to encounter a temperature significantly less than that generated by the heating cables;

connecting spoolable power cables between the uphole ends of said heat-stable cables and the terminals of a power supply, with said power cables having combinations of conductor cross-sections and resistances enabling them to develop insignificant heat while supplying an EMF at which said heating cables generate said selected temperatures; and operating said heating cables at said selected EMF.

25. A well heater for heating an interval of subterranean earth formation comprising:

at least two parallel strands of spoolable steel-sheathed, mineral-insulated heating cables having lengths of at least about 300 feet, having electrical current carrying cores which are electrically interconnected at their downhole ends and consist of metal strands of high electrical conductivity, arranged to provide combinations of cross-sections and core resistances capable of generating temperatures between about 600° and 1000° C. in response to a selected EMF of not more than about 1200 volts within an environment substantially free of convection;

said combinations of core cross-sections and resistances being arranged to provide a pattern of temperature with distance along the lengths of said heating cables which pattern is capable of substantially correcting for any variations in the pattern of heat conductivity with depth along said interval of subterranean earth formations, so that the heat injection rate is kept substantially constant along that interval; and spoolable power cables electrically connected between the uphole ends of said heating cables and the terminals of an electric power supply, with the power cables having combinations of core cross-sections and resistances causing the power cables to generate an insignificant amount of heat while conducting said selected EMF to the heating cables.

26. A well heater for heating an interval of subterranean earth formation comprising:

at least two parallel strands of spoolable steel-sheathed, mineral-insulated heating cables which (a) have lengths of at least about 300 feet, (b) contain electrical current carrying cores which are electrically interconnected at their downhole ends and consist of metal strands of high conductivity, and (c) are arranged to provide combinations of core cross-sections and core resistances capable of generating temperatures between about 600° and 1000° C. in response to a selected EMF of not more than about 1200 volts within an environment substantially free of convection;

said combinations of core cross-sections and resistances being arranged to provide a pattern of temperature with distance along the lengths of said heating cables which pattern substantially corrects for the pattern of heat conductivity along said interval of subterranean earth formation to be heated to maintain a substantially constant rate of heat injection with distance along that interval;

spoolable, steel-sheathed, mineral-insulated, heat-stable cables connected to the uphole ends of said heating cables with said heat-stable cables having (a) metal cores of high electrical conductivity (b) combinations of core cross-sections to resistances causing them to generate significantly less heat per EMF than said heating cables and (c) extending far enough away from said heating cables to encounter a temperature significantly less than the temperature generated by said heating cables; and spoolable power cables electrically connected between the uphole ends of said heat-stable cables and the terminals of an electric power supply, with the power cables having combinations of core cross-sections and resistances causing the power cables to generate an insignificant amount of heat while conducting said selected EMF to the heating cables.

27. A process for installing an electrical heater including at least one steel sheathed, mineral insulated heating cable having a relatively low electrical resistance and at least one power supplying cable interconnected so as to be capable of heating at rates of more than 100 watts per foot within the borehole of a well adjacent to an interval of subterranean earth formations to be conductively heated, comprising:

installing within the borehole a fluid-impermeable and heat-resistant hollow conduit which extends through the interval to be heated, is closed at its bottom end, and is arranged to prevent substantially any flow of fluid between its interior and the earth formations to be heated;

moving into said conduit a heater weight-carrying member comprising an elongated metallic column which is capable of being moved through the conduit along with the heating and power supplying cables of the heater which it supports the weight of those cables;

moving the heating and power supplying cables of the heater into said conduit simultaneously with the moving in of the weight-carrying member and connecting the cables to that member with heat stable connectors that are attached at intervals along which they are capable of supporting the intervening weight of cables; and connecting the upper end of the weight-carrying member so that it supports itself and the heater cables at a distance above the bottom of the surrounding conduit which is at least sufficient to prevent the buckling of the weight-carrying member and cables when expanded by the temperature to which the earth formations are heated.

28. The process of claim 27 in which the heater weight-carrying member is a spoolable stainless steel tube and is connected so that a significant portion of the length of it and the cables becomes compressively loaded when those elements are thermally expanded due to the bottom of the weight-carrying member resting on the bottom of the conduit containing them.

29. The process of claim 27 in which said guide column member is a spoolable stainless steel tube and is connected so that a significant portion of the length of it and the cables becomes compressively loaded when those elements are thermally expanded due to the bottom of the weight-carrying member resting on the bottom of the conduit containing them.

30. A process for installing an electrical heater including at least one steel sheathed, mineral insulated heating cable having a relatively low electrical resistance and at least one power supplying cable interconnected so as to be capable of heating at rates of more than 100 watts per foot within the borehole of a well adjacent to an interval of subterranean earth formations to be conductively heated, comprising:

installing within the borehole a fluid-impermeable and heat-resistant hollow conduit which extends through the interval to be heated, is closed at its bottom end, and is arranged to prevent substantially any flow of fluid between its interior and the earth formations to be heated;

moving into said conduit a guide column member which is weighted at the bottom to keep it straight and pull it through the conduit;

connecting the downhole end of said heating cables to said guide member, coiling the heating cables around a drum which surrounds the guide member and connecting their uphole ends to said power supplying cables;

concurrently with said moving into the conduit of the guide member, removing turns of the coiled heating cables from the drum so that the cables spiral around the guide member, are drawn into the surrounding conduit by the guide member and, when said moving in of the guide member is terminated and the downward tension is released, become pressed against the wall of the surrounding conduit and frictionally supported along that wall; and continuing said moving into the conduit of the guide member and heater cables until the heater cables are drawn into a location adjacent to the interval of earth formations to be heated.

* * * * *